US006889868B2

(12) United States Patent
Magid

(10) Patent No.: US 6,889,868 B2
(45) Date of Patent: May 10, 2005

(54) COUPON DISPENSER DEVICE

(75) Inventor: Edward Magid, Ivyland, PA (US)

(73) Assignee: FLOORgraphics, Inc., Princeton, NJ (US)

( * ) Notice: Subject to any disclaimer, the term of this patent is extended or adjusted under 35 U.S.C. 154(b) by 21 days.

(21) Appl. No.: 10/360,452

(22) Filed: Feb. 8, 2003

(65) Prior Publication Data

US 2004/0155051 A1 Aug. 12, 2004

(51) Int. Cl.[7] ..... A47K 10/24

(52) U.S. Cl. ..... 221/45; 221/197; 221/287; 221/52

(58) Field of Search ..... 221/45, 46, 47, 221/48, 49, 52, 59, 63, 197, 198, 287

(56) References Cited

U.S. PATENT DOCUMENTS

| | | | | | |
|---|---|---|---|---|---|
| 1,916,615 | A | * | 7/1933 | Haveles | 221/60 |
| 2,034,516 | A | * | 3/1936 | Hunt et al. | 221/59 |
| 2,153,472 | A | * | 4/1939 | Morris | 221/35 |
| 3,589,555 | A | * | 6/1971 | Burkhalter, Jr. | 221/35 |
| 3,613,958 | A | * | 10/1971 | Opp | 222/180 |
| 3,679,096 | A | * | 7/1972 | Musser | 221/56 |
| 4,005,801 | A | * | 2/1977 | Musser | 221/56 |
| 4,094,442 | A | * | 6/1978 | Radek | 221/59 |
| 4,329,001 | A | * | 5/1982 | Filipowicz et al. | 312/71 |
| 4,379,514 | A | * | 4/1983 | Joffe | 221/279 |
| 4,411,374 | A | * | 10/1983 | Hotchkiss | 221/63 |
| 4,562,938 | A | * | 1/1986 | Loder | 221/46 |
| 4,838,454 | A | * | 6/1989 | Salzmann et al. | 221/57 |
| 4,840,291 | A | * | 6/1989 | Merlin | 221/59 |
| 4,913,312 | A | * | 4/1990 | Boutin | 221/45 |
| 4,953,747 | A | * | 9/1990 | Wenkman et al. | 221/45 |
| 5,076,466 | A | * | 12/1991 | Petterson et al. | 221/46 |
| 5,131,561 | A | * | 7/1992 | Casperson et al. | 221/35 |
| 5,622,281 | A | * | 4/1997 | Annand | 221/48 |
| 6,193,103 | B1 | * | 2/2001 | Clarijs | 221/25 |
| 6,286,713 | B1 | * | 9/2001 | Chan et al. | 221/49 |
| 6,334,544 | B1 | * | 1/2002 | Christensen et al. | 221/63 |
| 6,585,129 | B2 | * | 7/2003 | Moody et al. | 221/44 |

* cited by examiner

*Primary Examiner*—Kathy Matecki
*Assistant Examiner*—Rashmi Sharma
(74) *Attorney, Agent, or Firm*—Armand M. Vozzo, Jr.

(57) ABSTRACT

An improved coupon dispenser device is disclosed comprising an outer box having a sloped front end with rectangular opening therein, a channeled inner sleeve longitudinally extending through the outer box, and a curved, spring-loaded pusher member therein contained and directed to urge a stack of folded coupon sheets axially through the sleeve and to the opening in the outer box in a deflected manner. The inner sleeve is constructed having channeled top and bottom wall surfaces substantially saw-tooth in their configuration and further formed having a sloped profile at its open front end conforming with the sloped front end of the outer box. The sloped front end of the outer box is formed in two divergent planes established by separate top and bottom panels positioned on either side of the opening so that the outermost coupon sheet is delivered at the opening with its leading flap extending therefrom in a position of easy retrieval for the consumer. The coupon dispenser device may be mounted upon a store shelf or other like surface using conventional means.

13 Claims, 6 Drawing Sheets

COUPON DISPENSER DEVICE

BACKGROUND OF THE INVENTION

The present invention relates to devices for delivering retail promotions, such as product or price coupons, in the form of individual sheets of paper to a consumer at a point-of-purchase, and more particularly to a coupon dispensing device wherein a specially configured outer box having a sloped front end set in two divergent planes and a channeled inner sleeve extending longitudinally through the outer box are combined with a spring-loaded pusher member to improve distribution and delivery of a stack of folded coupons stored within the device.

In the field of retail marketing and store promotions, the use of coupon dispensers is widespread particularly at the point of consumer selection and purchase of the product. Often mounted on retail shelves in proximity to the associated product, these coupon dispensers have traditionally been mechanical or electro-mechanical in their operation and have been designed in a variety of configurations to deliver a supply of stored coupons one at a time to an interested consumer. The coupons are generally stored in a folded stack within these dispensing devices to facilitate their distribution and delivery, and spring pressure is usually applied to the coupon stack to maintain a steady directional force that feeds the stored coupons toward an open end of the device through which the coupons may be individually retrieved.

Many prior art coupon dispenser devices have been devised and constructed in an effort to provide a complete and continuous flow of the coupons stored therein and their repetitive delivery one-at-a-time to the consumer. In addition to construction variations found in the prior art dispensing devices, the use of specially interfolded coupon sheets, with and without adhesive backings, has been incorporated into the working arrangement of these pre-existing coupon dispensers in an attempt to achieve a more consistent distribution and the sequential delivery of the coupons being dispensed. While the variety of pre-existing coupon dispensers and their associated interfolded coupon stacks have been generally satisfactory, they have not proven to ensure a repeatable individual delivery of coupons, regardless of their size and shape, in a retrieval manner that is easily accessible for the consumer. Although electrically powered coupon dispensing devices have proven capable of the repetitive delivery of the coupons in sequence, they are prone to failure due to their power requirements and complex mechanizations.

SUMMARY OF THE INVENTION

Accordingly it is a general purpose and object of the present invention to provide an improved device for dispensing coupons or other sheet material sequentially and one at a time from a stored stack contained therein.

A more particular object of the present invention is to provide and improved coupon dispensing device that holds a stack of coupons in a specially structured internal arrangement for a more consistent distribution and positive discharge of the coupons sequentially throughout the device.

Another object of the present invention is to provide a coupon dispenser device that provides a repeatable discharge and individual delivery of coupons in a form that is accessible and easy for the consumer to retrieve and remove.

Still another object of the present invention is to provide a coupon dispenser device that is reliable in its dispensing operation and made to resist jamming of the coupons contained therein.

A still further object of the present invention is to provide a reliable coupon dispenser device that is easy to make and assemble, readily mounted to store shelves and adaptable to a variety of specialized promotions.

Briefly, these and other objects of the present invention are accomplished by an improved coupon dispenser device comprising an outer box having a sloped front end with rectangular opening therein, a channeled inner sleeve longitudinally extending through the outer box, and a curved, spring-loaded pusher member therein contained and directed to urge a stack of folded coupon sheets axially through the sleeve and to the opening in the outer box in a deflected manner. The pusher member is formed having a convex head that applies spring pressure from a compression spring to the stack of coupon sheets within the inner sleeve, each sheet having a Z-folded form with leading and trailing flaps of disproportionate lengths. The inner sleeve is constructed having channeled top and bottom wall surfaces substantially saw-tooth in their configuration and further formed having a sloped profile at its open front end conforming with the sloped front end of the outer box. The sloped front end of the outer box is formed in two divergent planes established by separate top and bottom panels positioned on either side of the opening so that the outermost coupon sheet is delivered at the opening with its leading flap extending therefrom in a position of easy retrieval for the consumer. The coupon dispenser device may be mounted upon a store shelf or other like surface using conventional means.

For a better understanding of these and other aspects of the present invention, reference should be made to the following detailed description taken in conjunction with the accompanying drawings in which like reference numerals and characters designate like parts throughout the figures thereof.

BRIEF DESCRIPTION OF THE DRAWINGS

For a fuller understanding of the nature and object of the present invention, references in the detailed description of the preferred embodiment set forth below shall be made to the accompanying drawings in which.

DETAILED DESCRIPTION OF THE INVENTION

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to the appended claims.

Figure 1:
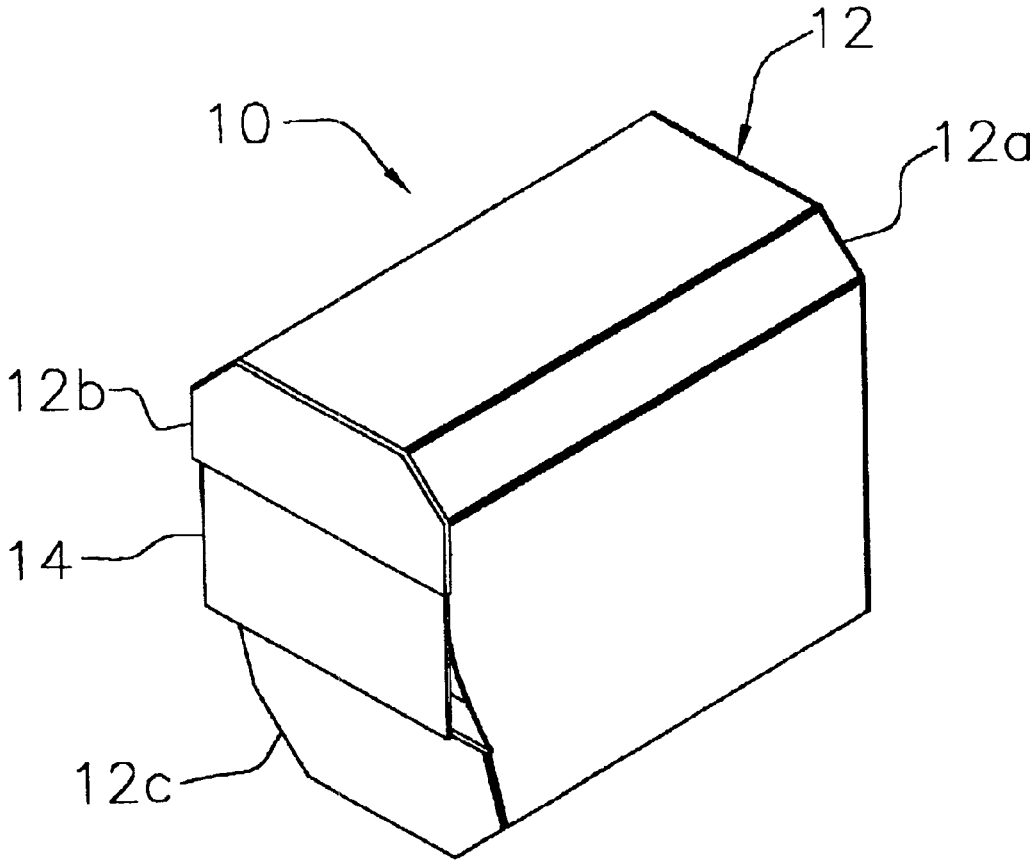
FIG. 1 a front perspective view of a coupon dispenser device made in accordance with the present invention.
Figure 2:
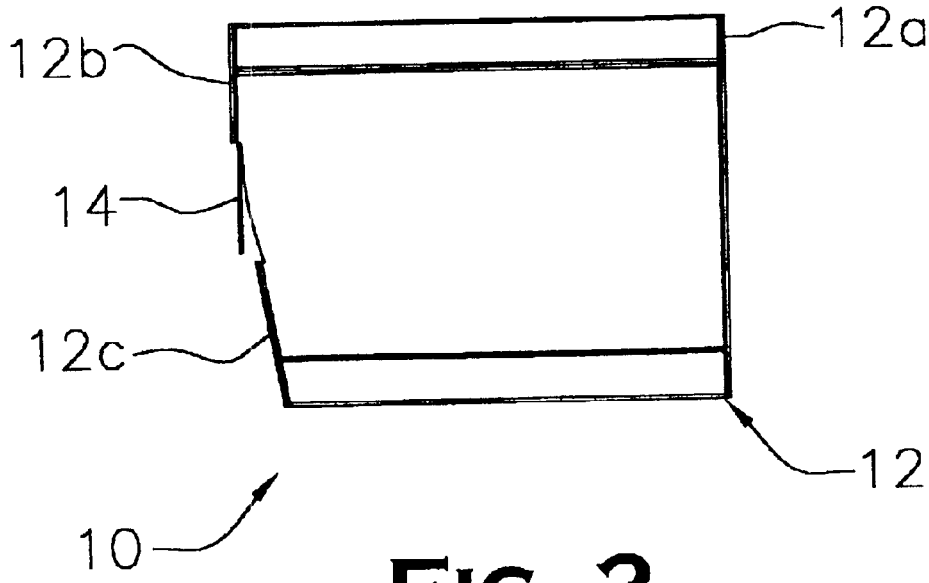
FIG. 2 is a side elevation view of the coupon dispenser device shown in FIG. 1.

Referring now to the drawings and particularly at first FIGS. 1 and 2, the coupon dispenser device of the present invention, generally designated 10, is shown assembled and ready to deliver a coupon sheet 14 or like piece of promotional material for retrieval by a consumer. The exterior of the coupon dispenser device 10 comprises an outer box 12 having top, bottom, back and side walls substantially normal to each other. Made from a stiff, relatively thick paper material, preferably cardboard, the outer box 12 is further formed having flattened sections 12*a* connecting the top, bottom and side walls at comers around the body of the outer box and along the length thereof. In this described configuration, the outer box 12 may be fabricated from a single, pre-formed and scored piece of cardboard material that is folded to close the top, bottom, and sidewalls in connection with the back. Mounting holes 22 formed in the back of the outer box 12, as better seen in FIG. 3, are provided to permit mounting of the dispenser device 10 on a retail store shelf (not shown) or like surface.

The front end of the outer box 12 serves as the dispensing end of the present dispenser device 10. The front end of outer box 12 is sloped gradually downward and inward from the upper part of the box to the bottom thereof, the sloped profile being formed in two divergent planes established by a top panel 12*b* and separate bottom panel 12*c* each connected across the front end between the sidewalls of the outer box. Between the top panel 12*b* and the bottom panel 12*c*, a rectangular opening bounded by the proximate edges of the top and bottom panels and the sloping edges on either sidewall is formed for discharging the outermost coupon 14 of those stored in dispenser device 10. In elevation, this opening is approximately the same height as each of the respective panels 12*a* and 12*b*. The top panel 12*b* is made to conform with the associated edges of the top wall and the flattened corner sections 12*a* on the upper part of the outer box 12 and is secured thereto between opposite side walls of the box at a substantially perpendicular attitude relative to the top wall. The bottom panel 12*c* is similarly made to conform with the associated edges of the bottom wall and flattened sections 12*a* on the lower part of the outer box 12 and is secured thereto between the side walls across the bottom of the outer box. However, as best seen in FIG. 2, the bottom panel 12*c* is disposed upon the inclined forward edge of the side walls of outer box 12 in a recessed position relative to the top panel 12*b* and in a plane that is divergent from the plane of the top panel at an obtuse angle relative thereto. This recessed and angled position of the bottom panel 12*c* relative to the top panel 12*b* on the front end of outer box 12 permits the proper discharge and release of the outermost coupon sheet 14 with a tongue effect exhibited thereby outward through the opening between the panels. Combined with the Z-folded form of each coupon sheet 14 and the spring-loaded distribution of the folded coupon sheets stored within the dispenser device 10, both described below in greater detail, the sloped front end of the outer box 12 with its separated top and bottom panels, 12*b* and 12*c* respectively, provides the delivery of the outermost sheet with the tongue effect at the point of discharge for easy access and retrieval of each coupon by the consumer.

Figure 3:
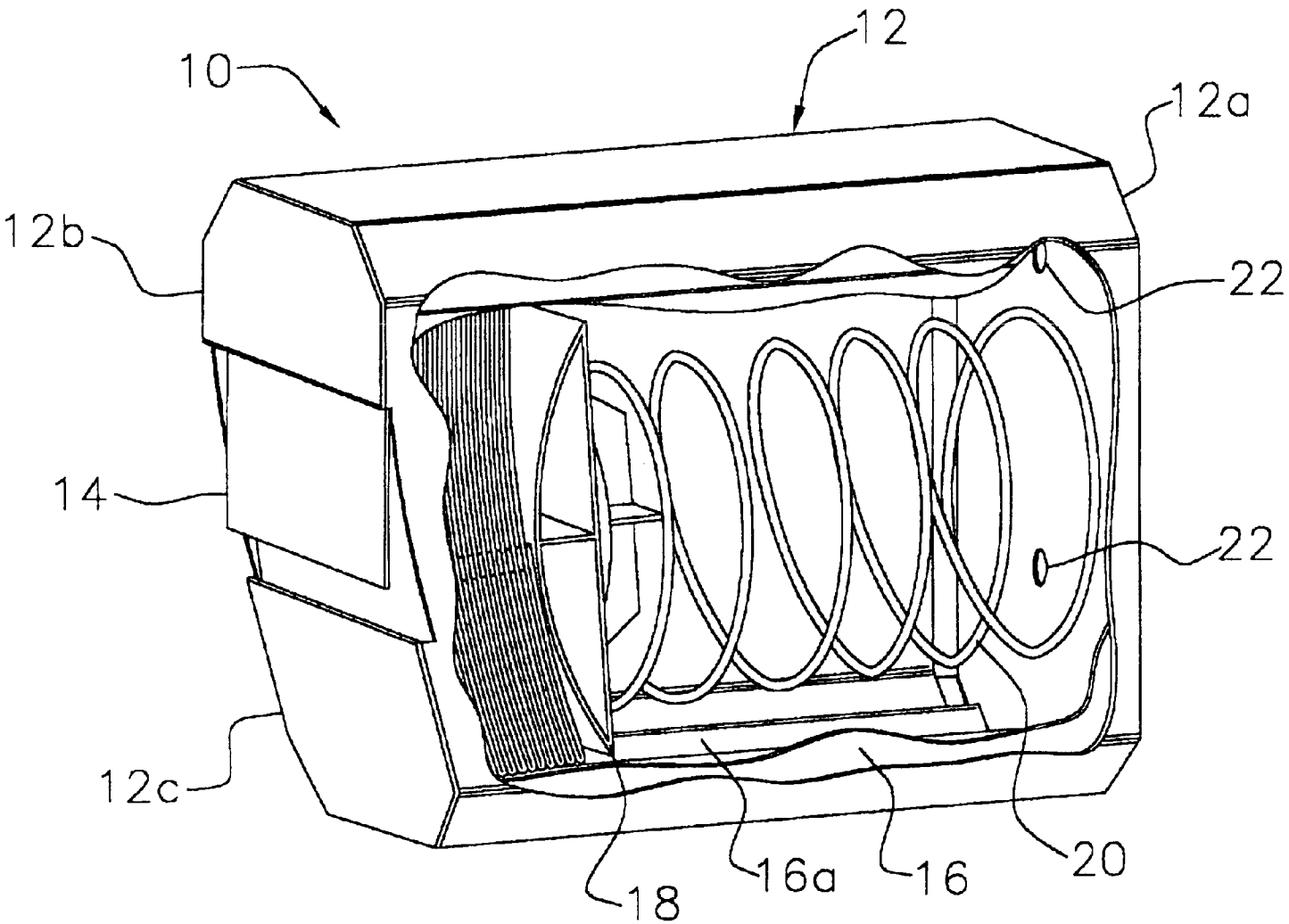
FIG. 3 is a perspective view of the coupon dispenser device, as shown in FIGS. 1 and 2, with a side section of the device cutaway to present an internal view of the inventive device.
Figure 4:
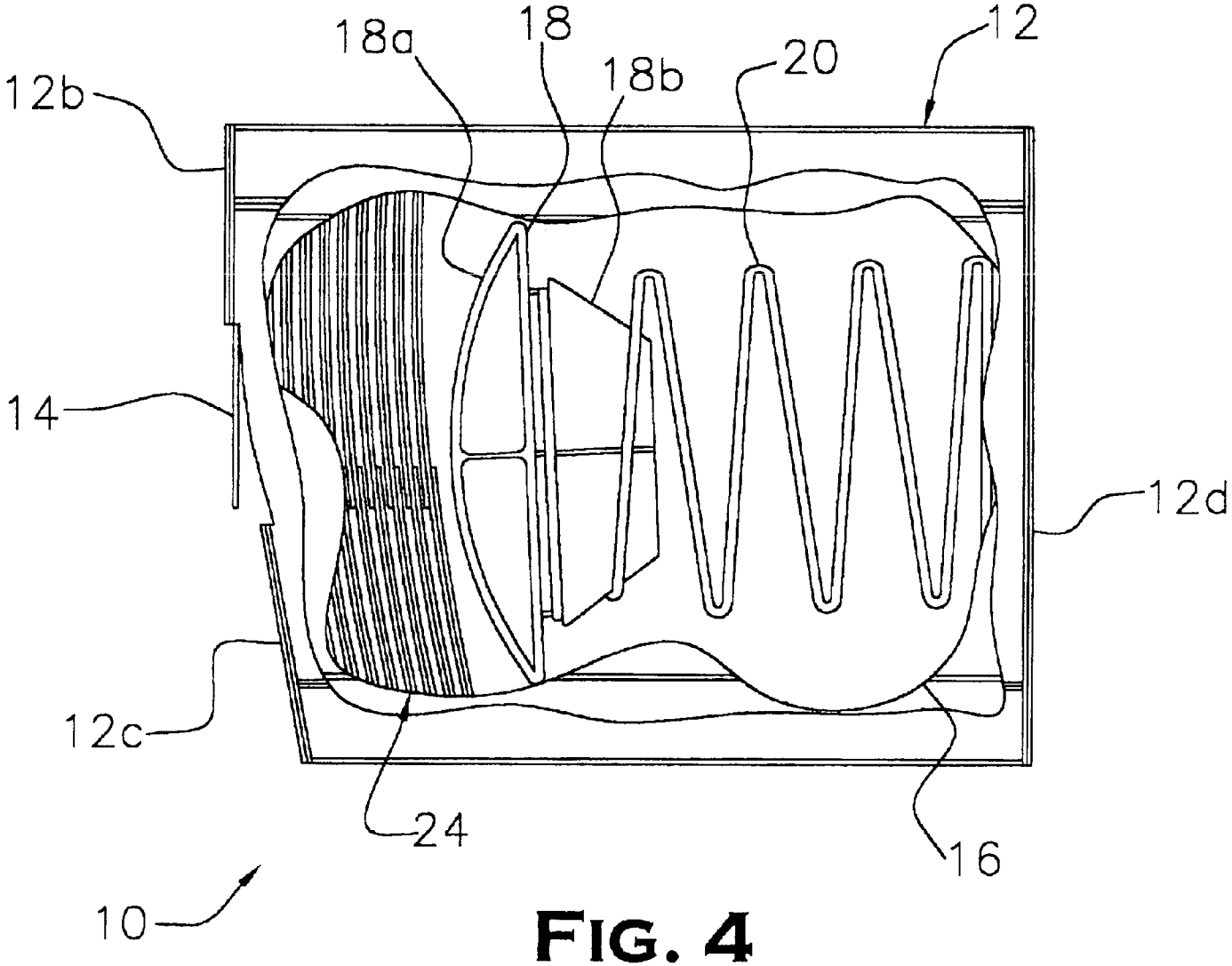
FIG. 4 is a side elevation of the coupon dispenser device as shown in the cutaway view of FIG. 3.

Referring now to FIGS. 3 and 4, the internal working structure and operation of the coupon dispenser device 10 is shown relative to the outer box 12. An inner sleeve 16 made of the same material and general size as the outer box 12 is longitudinally disposed within the chamber of the sleeve, the inner sleeve being open at both the front and back ends thereof. In its length and width dimensions, the inner sleeve 16 conforms substantially to the corresponding dimensions of the outer box 12 so that the inner sleeve may fit snugly and completely within the outer box. As better shown and described below with respect to FIG. 5, the inner sleeve 16 is formed particularly having the open front end thereof sloped in its profile substantially the same as the sloped surface on front end of the outer box 12. This similarly sloped profile on the front end of the inner sleeve 16 allows the sleeve to be positioned immediately adjacent to and against the inside surface of the front end of the outer box 12 and ensure the proper delivery of the outermost coupon sheet 14 from the stack of sheets 24 in the chamber of the inner sleeve and through to the opening between the top panel 12*b* and bottom panel 12*c* on the front end of the outer box.

Figure 5:
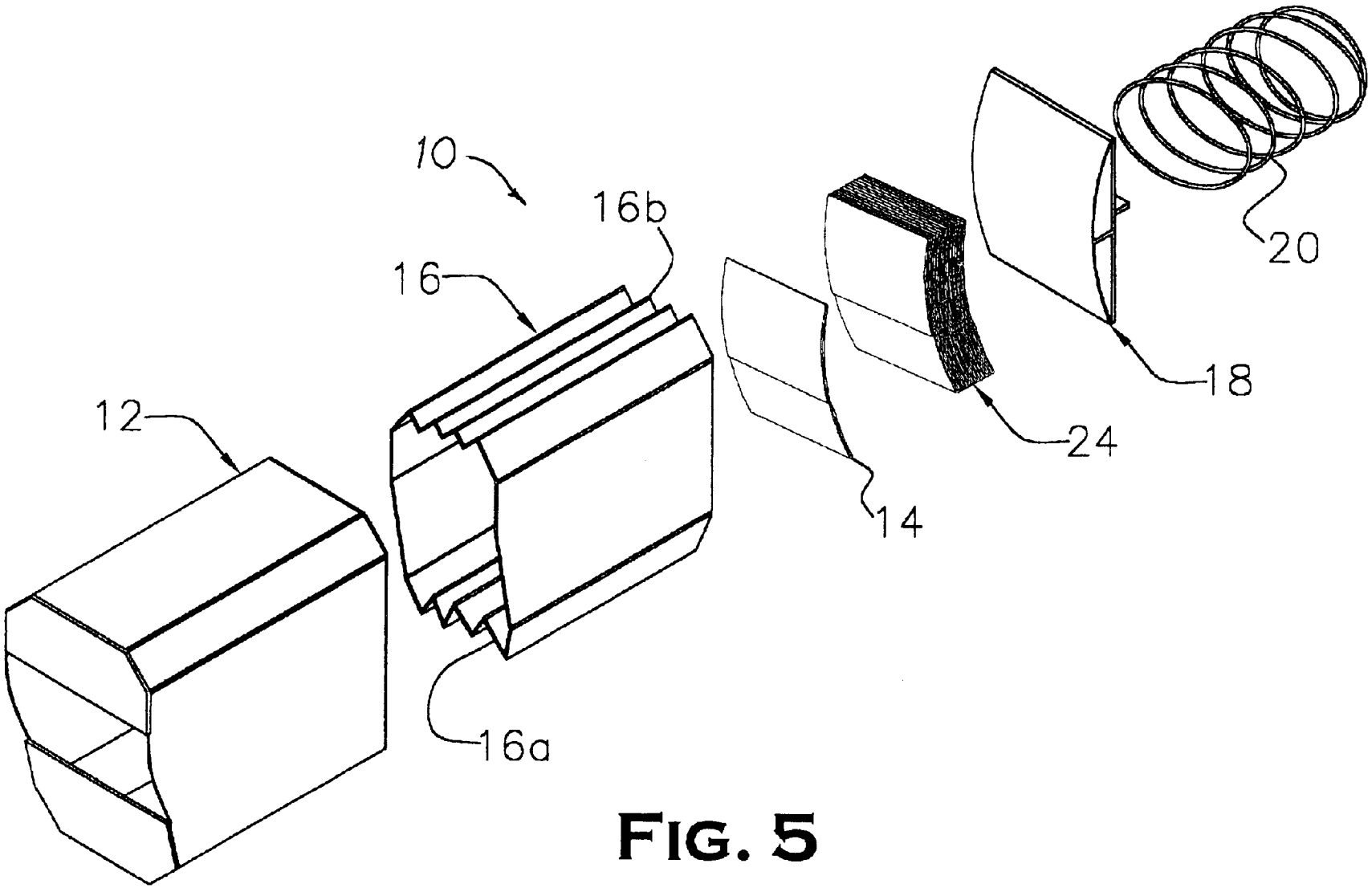
FIG. 5 is an exploded perspective view of the coupon dispenser device shown in FIGS. 1–4.

Referring further to FIG. 5 in conjunction with FIGS. 3 and 4, the stack of coupon sheets 24 held within the chamber of inner sleeve 16 are rectangular in form, each sheet being uniformly folded in a Z-like configuration having a forward-facing leading flap and a rearward-facing trailing flap extending respective lengths in opposite directions on either side of a central panel. Preferable but not essential to the operation of the present coupon dispenser device 10, the leading flap of each of the coupon sheets 24 may be made disproportionately longer than the trailing flap to promote a forward deflection of the stack through the inner sleeve 16 that ensures the tongue effect exhibited by the outermost coupon sheet 14 at the opening in the front-end of outer box 12. The central panel of each coupon sheet 14 is rectangularly shaped and sized to approximate the chamber of inner sleeve 16 so that with the respective flaps folded over and onto opposite sides of the central panel, each folded sheet in the stack 24 is sized to fit snugly within the chamber of the inner sleeve. It should be noted and understood that the respective flaps of each folded coupon sheet 14 need not be interleaved with the flaps of adjacent sheets in the coupon stack 24 in order to be dispensed in accordance with the present invention.

The open-ended inner sleeve 16 is constructed having substantially flat and parallel sidewalls and separate channeled surfaces 16*a* and 16*b* that are substantially saw-tooth in configuration along the respective bottom and top walls of the inner sleeve. The respective channeled wall surfaces 16*a* and 16*b* are substantially the same in form and continuous in their saw-tooth configuration fully extending between the sidewalls of the inner sleeve 16. The innermost edges of the channeled bottom and top wall surfaces 16*a* and 16*b* are typically separated in elevation by the approximate length of the folded coupon sheet 24 and thus serve to contain the stack of coupon sheets 24 substantially vertically within the chamber of the inner sleeve 16. Together with the sidewalls of the inner sleeve 16, the channeled wall surfaces 16*a* and 16*b* serve to support the stack of coupons 24 on all sides thereby holding the stack in proper position for distribution. The outermost edge of the channeled wall surfaces 16*a* and 16*b* consequently are positioned to support the top and bottom surfaces of the outer box 12 particularly when the stack of coupon sheets 24 are held within the chamber of the inner sleeve 16. It should therefore be recognized that the channeled bottom and top wall surfaces 16*a* and 16*b* of the inner sleeve 16, particularly in its saw-tooth configuration, provide a degree of flexibility to the size and form of the chamber used to contain and hold the stack of folded coupon sheets 24. Furthermore, it should be noted that the channeled bottom and top walls 16*a* and 16*b* with their continuous saw-tooth edges running the length of the inner sleeve 16 reduce the coefficient of drag on the coupon stack 24 during its distribution and thereby provides a more consistent and positive flow of coupons throughout the present dispenser device 10.

Distribution of the coupon stack 24 within the present dispenser device 10 and consequent forward movement of the individual coupon sheets 14 therethrough are effected by means of a spring force that is supplied by a helical coil compression spring 20 and applied to the coupon stack by a curved pusher member 18. The pusher member 18 and compression spring 20 are coupled together and disposed longitudinally within the inner sleeve 16 with the free end of the spring pressing flush against the inside back wall of the outer box 12. The pusher member 18 is formed and adapted to provide a curved head 18*a* having a convex forward surface that applies the required spring force to the coupon stack 24 in a bowed or deflected manner corresponding with the convex curvature of the forward surface. This bowed deflection of the coupon stack 24 contributes to the tongue effect produced upon the outermost coupon sheet 14 at the forward opening of the outer box 12. The curved head 18*a* is further sized and shaped in its width and height to conform substantially to the chamber of the inner sleeve 16 so that the pusher member 18 may move freely therethrough without restriction.

Figure 6:
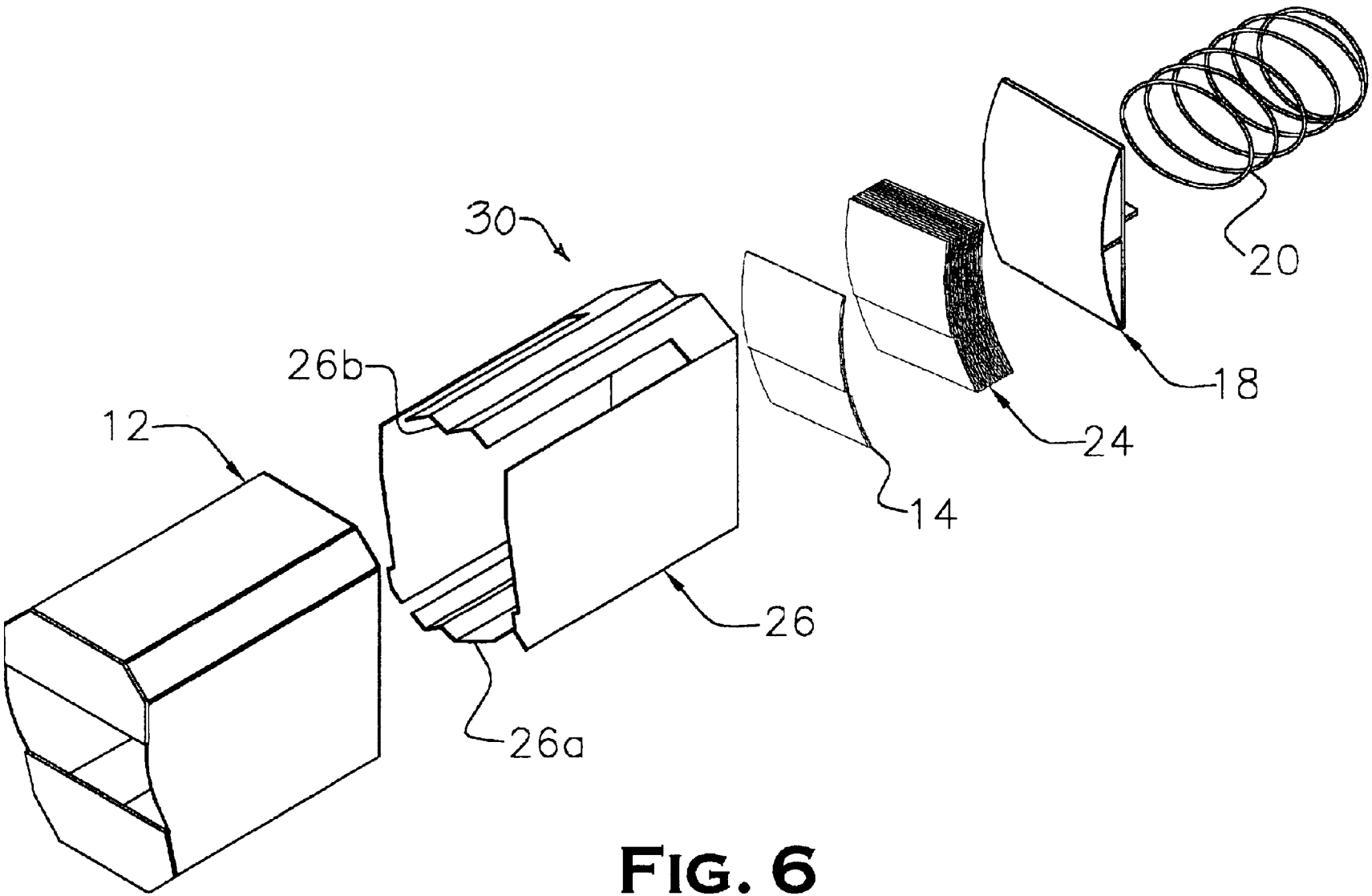
FIG. 6 is an exploded perspective view of an alternate embodiment of the coupon dispenser device according to the present invention.
Figure 8:
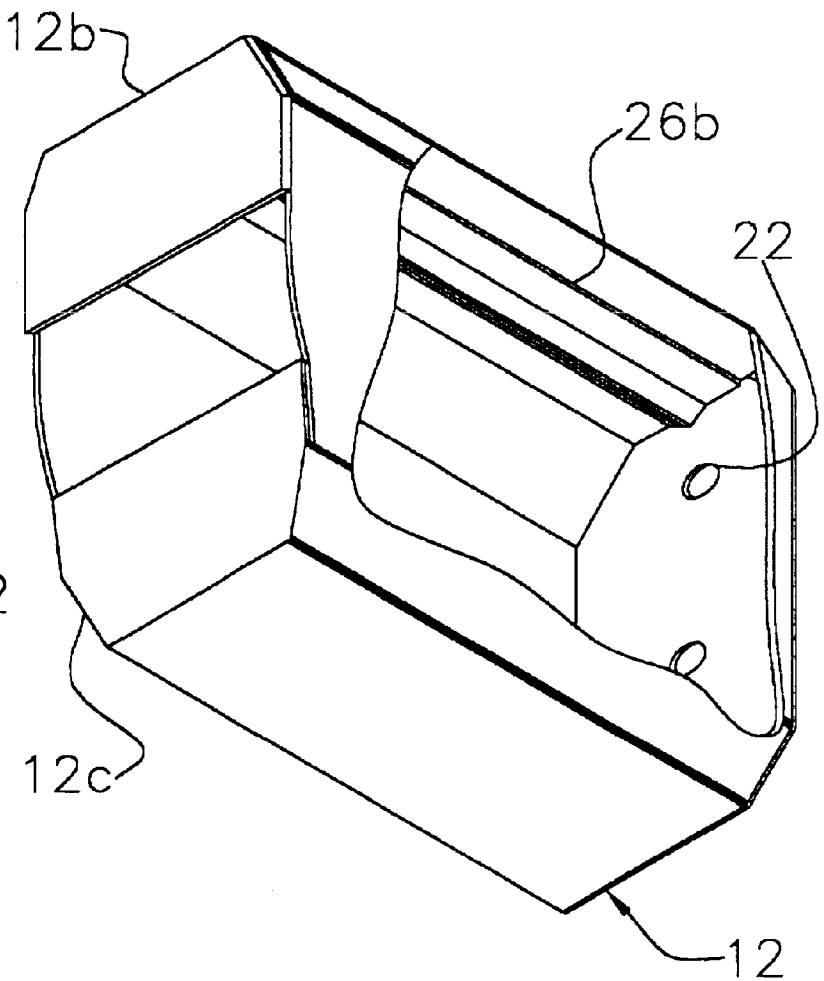
FIG. 8 is a front perspective view of the exterior of the coupon dispenser device, as shown in FIG. 7 with side portion cutaway, but viewed from below.
Figure 7:
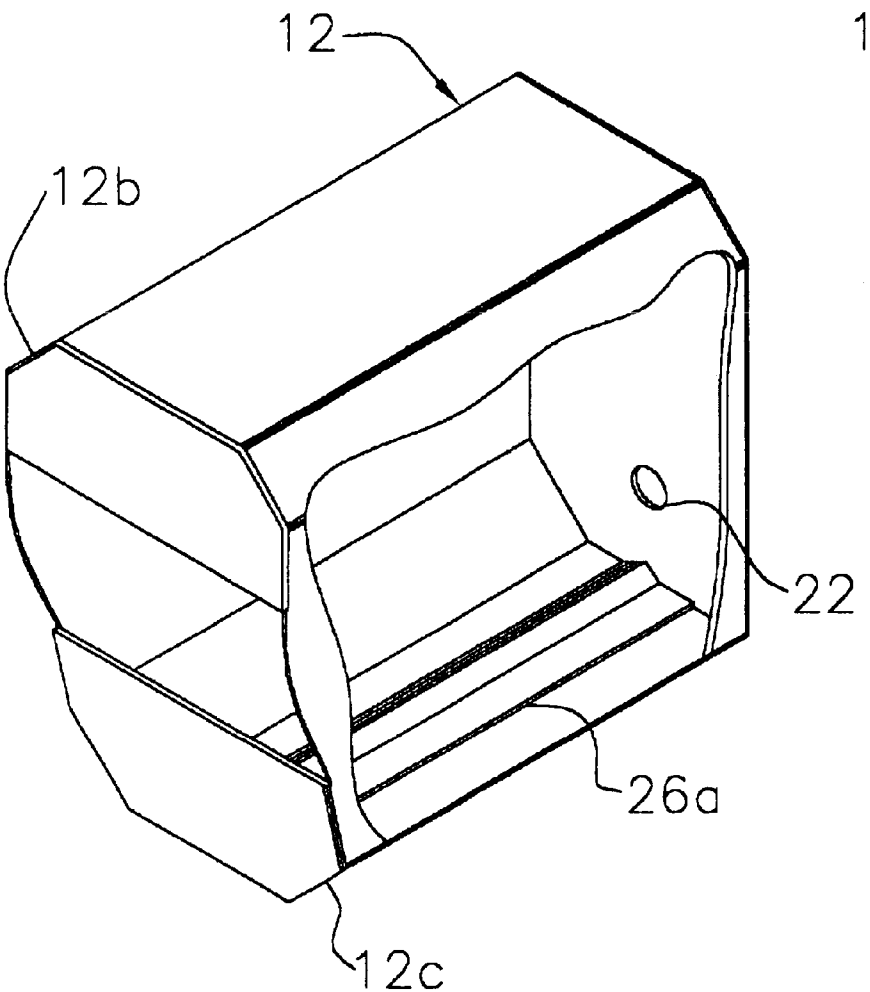
FIG. 7 is a front perspective view of the exterior of the coupon dispenser device of FIG. 6, shown from above and with a side portion cutaway.

Referring now to FIG. 6, an alternate embodiment of the present coupon dispenser device, generally designated 30, is shown comprising those same elements of the aforedescribed device except for the substitution of an optional version of the inner sleeve, designated as 26. Inner sleeve 26 is similarly open at both its front and back ends as the aforedescribed sleeve 16 and is further formed with substantially parallel side walls having the forward edges thereof sloped in their profile substantially the same as the sloped surface on the front end of outer box 12, the sloped profile corresponding to that of the square top panel 12*b*, angled bottom panel 12*c* and sloped opening therebetween. Inner sleeve 26 is distinct and altered in its form from that of inner sleeve 16 by the incorporation of non-continuous channeled surfaces 26*a* and 26*c* on the bottom and top of the inner sleeve. While these non-continuous channeled surfaces 26*a* and 26*b* are characterized by a saw-tooth configuration like that of the bottom and top wall surfaces 16*a* and 16*b* of inner sleeve 16, the channeled surfaces on the top and bottom of inner sleeve 26 are spaced apart from the sidewalls on each side of the sleeve and not completely closed along the top and bottom thereof. As viewed in both FIGS. 7 and 8, the non-continuous bottom and top surfaces 26*a* and 26*b* of inner sleeve 26 provides the chamber of the sleeve with the same channeled system extending through the length of the outer box 12 that not only contains the stack of coupon sheets 24 with an increased degree of flexibility and support but that also improves the flow and distribution of the stack of coupon sheets 24 contained therein. As shown in FIG. 6, the same spring-loaded force is supplied and applied to the coupon stack 24 by means of the curved pusher member 18 and helical coil compression spring 20 coupled together and mounted longitudinally within the inner sleeve 26 and outer box 12.

Therefore, it is apparent that the described invention provides an improved device for dispensing coupons and other promotional sheet material sequentially from a stacked supply. The present inventive device more particularly provides an improved coupon dispenser that distributes a stack of folded coupons in a more consistent form and sequentially delivers the coupons in a manner that is accessible and easy for the consumer to retrieve and remove. The internal structure of the present coupon dispenser device, particularly the channeled sleeves and their saw-tooth upper and lower surfaces, produces a reduced coefficient of drag on the stack of coupons during distribution for a smooth and reliable flow of the coupons through the device. The external structure of the present coupon dispenser device, particularly the sloped front end of the outer box formed in separate planes, combines with the inner sleeve structure and the spring-loaded pusher member disposed therein to produce a consistent and repeatable tongue effect upon the individual coupons at the point of discharge and delivery so that each may be easily withdrawn one at a time without jamming. In addition, the described coupon dispenser device of the present invention is easy to make and assemble, readily mounted to store shelves and adaptable to a variety of specialized store promotions that may be packaged in different configurations.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. Accordingly, it is understood that this invention is not limited to the particular embodiment described, but rather is intended to cover modifications within the spirit and scope of the present invention as expressed in the appended claims.

What is claimed is:

1. A device for dispensing a stack of coupon sheets each folded having a forward flap thereon, comprising:

an outer box member having a sloped front surface with an opening therein, the sloped front surface being formed in two divergent planes;

an inner sleeve member longitudinally disposed within said outer box member for holding the stack of coupon sheets axially therein, said sleeve member being formed having channeled surfaces of a substantially saw-tooth configuration extending along the top and bottom walls thereof; and pusher means disposed within said inner sleeve member for urging the stack of coupon sheets axially therethrough and in a deflected manner toward the opening in the front surface of said outer box member so that the forward flap on the outermost coupon sheet extends outward through the opening.

2. A dispensing device according to claim 1, wherein said outer box member further comprises:

a box body having top, bottom, back and side walls interconnected and substantially rectangular in form;

a top panel connected across the sloped front surface of said outer box member above the opening therein and positioned in a first plane substantially normal to the top wall of the box body; and a bottom panel connected across the sloped front surface below the opening therein, the bottom panel being recessed in its position on the front surface relative to the top panel and inclined in a second plane divergent from the first plane.

3. A dispensing device according to claim 2, wherein the box body is formed having flattened sections at corners connecting respective walls along the length of the box body.

4. A dispensing device according to claim 3, wherein the back wall of the box body is provided with mounting holes therein.

5. A dispensing device according to claim 1, wherein said pusher means comprises:

a pusher member adapted to fit within said inner sleeve member and formed having a curved forward surface thereon; and a compression spring coupled to said pusher member and disposed axially within said inner sleeve member.

6. A dispensing device according to claim 5, wherein the curved forward surface of said pusher member is convex in its configuration.

7. A device for dispensing a stack of coupon sheets each folded in a Z-form having a leading and trailing flap, comprising:

an outer box member having a sloped front surface with a rectangular opening therein, the sloped front surface including a top panel disposed above the opening in a first plane and a bottom panel disposed below the opening in a recessed position relative to the top panel and in a second plane divergent from the first plane;

an inner sleeve member disposed within said outer box member for holding the stack of coupon sheets axially therein, said sleeve member being open at front and back ends thereof and formed having channeled surfaces of a substantially saw-tooth configuration extending along the top and bottom walls; and pusher means axially disposed within said inner sleeve member for urging the stack of coupon sheets in a deflected manner through said inner sleeve member and toward the opening in the sloped front surface of said outer box member so that the leading flap of the outermost coupon sheet projects outward through the opening.

8. A dispensing device according to claim 7, wherein said inner sleeve member is further formed having the open front end thereof sloped to substantially conform with the sloped front surface of said outer box member.

9. A dispensing device according to claim 7, wherein said pusher means comprises:

a pusher member formed to fit within said inner sleeve member for axial movement therethrough, said pusher member having a curved forward surface thereon; and spring means for forcing said pusher member axially through said inner sleeve.

10. A dispensing device according to claim 9, wherein the curved surface of said pusher member is convex in configuration.

11. A dispensing device according to claim 10, wherein said spring means comprises a compression coil spring.

12. A dispensing device according to claim 7, wherein said outer box member further comprises:

a box body having interconnected top, bottom, back and side walls in substantially rectangular form and further formed having flattened corner sections disposed between respective walls along the length of the box body.

13. A dispensing device according to claim 12, wherein the back wall of the box body is provided with mounting holes therein.

* * * * *